US009077132B2

(12) United States Patent
Mahlin

(10) Patent No.: US 9,077,132 B2
(45) Date of Patent: Jul. 7, 2015

(54) MALE CONNECTOR AND A METHOD OF PRODUCING THE MALE CONNECTOR

(75) Inventor: Fredrik Mahlin, Uppsala (SE)

(73) Assignee: ST. JUDE MEDICAL COORDINATION CENTER BVBA, Zaventem (BE)

( * ) Notice: Subject to any disclaimer, the term of this patent is extended or adjusted under 35 U.S.C. 154(b) by 137 days.

(21) Appl. No.: 13/695,130

(22) PCT Filed: Apr. 14, 2011

(86) PCT No.: PCT/EP2011/055920

§ 371 (c)(1),
(2), (4) Date: Oct. 29, 2012

(87) PCT Pub. No.: WO2011/134801

PCT Pub. Date: Nov. 3, 2011

(65) Prior Publication Data

US 2013/0045640 A1 Feb. 21, 2013

Related U.S. Application Data

(60) Provisional application No. 61/329,630, filed on Apr. 30, 2010.

(30) Foreign Application Priority Data

Apr. 30, 2010 (SE) ..... 1050429

(51) Int. Cl.
*H01R 24/04* (2006.01)
*H01R 24/58* (2011.01)
(Continued)

(52) U.S. Cl.
CPC ..... *H01R 24/58* (2013.01); *Y10T 29/4922* (2015.01); *Y10T 29/49222* (2015.01); *Y10T 29/49213* (2015.01); *H01R 43/16* (2013.01); *H01R 43/24* (2013.01); *H01R 2201/12* (2013.01)

(58) Field of Classification Search
CPC . H01R 24/58; A61B 6/481; A61M 25/09041; A61M 25/0108; A61M 25/09
USPC ..... 439/669; 600/433–435, 585
See application file for complete search history.

(56) References Cited

U.S. PATENT DOCUMENTS 5,715,817 A * 2/1998 Stevens-Wright et al. ... 600/373
6,090,052 A 7/2000 Akerfeldt et al.

(Continued)

FOREIGN PATENT DOCUMENTS

JP 2003/265617 A 9/2003
WO WO 2009/054805 A1 4/2009
WO WO 2009/091495 A2 7/2009

*Primary Examiner* — Thanh Tam Le
(74) *Attorney, Agent, or Firm* — Foley & Lardner LLP

(57) ABSTRACT

The present invention relates to an elongated male connector (1), for a medical device, and a method of producing the male connector (1). The male connector (1) has a longitudinal axis (2) and comprises a plurality of conductive members (3), each having an outer contact surface (4) and being separated from each other by insulating members (5). The conductive and insulating members (3, 5) are disposed along the male connector (1), such that the outer contact surfaces (4) are arranged essentially at the same surface level, and that each of the conductive members (3) has an elongated extension along the longitudinal axis (2) of the male connector (1). Each conductive member (3) is provided with an insulated microrod (6) extending at least partially along the length of the male connector (1), and the conductive members (3) are hollow and have an essentially cylindrical cross-section and form, together with the insulating members (5), a self-supporting male connector (1) having no core wire.

14 Claims, 3 Drawing Sheets

(51) Int. Cl.
*H01R 43/16* (2006.01)
*H01R 43/24* (2006.01)

(56) References Cited

U.S. PATENT DOCUMENTS

| | | | | |
|---|---|---|---|---|
| 6,196,980 | B1 | 3/2001 | Akerfeldt et al. | |
| 6,261,246 | B1 * | 7/2001 | Pantages et al. | 600/585 |
| 6,439,933 | B1 | 8/2002 | Moji | |
| 6,451,026 | B1 * | 9/2002 | Biagtan et al. | 606/108 |
| 6,485,440 | B1 * | 11/2002 | Gardeski | 600/585 |
| 6,512,957 | B1 * | 1/2003 | Witte | 607/116 |
| 6,636,758 | B2 * | 10/2003 | Sanchez et al. | 600/434 |
| 6,908,442 | B2 | 6/2005 | Von Malmborg et al. | |
| 6,970,747 | B2 * | 11/2005 | Kokones et al. | 607/116 |
| 7,798,980 | B2 * | 9/2010 | Melsheimer | 600/585 |
| 7,896,708 | B2 * | 3/2011 | Agevik | 439/669 |
| 7,914,466 | B2 * | 3/2011 | Davis et al. | 600/585 |
| 8,075,497 | B2 * | 12/2011 | Melsheimer | 600/585 |
| 8,133,190 | B2 * | 3/2012 | Melsheimer et al. | 600/585 |
| 8,676,301 | B2 * | 3/2014 | Coyle | 600/434 |
| 2004/0186542 | A1 | 9/2004 | Van Venrooij et al. | |
| 2005/0091833 | A1 | 5/2005 | Kiepen et al. | |
| 2007/0106142 | A1 | 5/2007 | Von Malmborg et al. | |
| 2008/0160843 | A1 | 7/2008 | Chen et al. | |
| 2008/0255446 | A1 | 10/2008 | Akins | |
| 2009/0254162 | A1 | 10/2009 | Quinei et al. | |

* cited by examiner

MALE CONNECTOR AND A METHOD OF PRODUCING THE MALE CONNECTOR

FIELD OF THE INVENTION

The present invention relates to an injection-mouldable male connector for a medical device and a method of producing the male connector.

BACKGROUND OF THE INVENTION

In many medical procedures, various physiological conditions present within a body cavity need to be monitored. These physiological conditions are typically physical in nature—such as pressure, temperature, rate-of-fluid flow, and provide the physician or medical technician with critical information as to the status of a patient's condition.

For example, one medical device that is widely used to monitor conditions is a intravascular pressure sensor. The pressure sensor senses the magnitude of a patient's blood pressure, and converts it into a representative electrical signal that is transmitted to the exterior of the patient. For most applications it is also required that the sensor is electrically energized. Some means of signal and energy transmission for such a medical device is thus required.

For the blood pressure sensor, most commonly, extremely thin electrical cables, sometimes called microcables, are provided inside a guide wire, which itself preferably is provided in the form of a tube, which often has an outer diameter in the order of 0.35 mm, and oftentimes is made of steel. In order to increase the bending strength of the tubular guide wire and improve pushability and torque response, a core wire may be positioned inside the tube. The mentioned electrical cables are then e.g. positioned in the space between the inner lumen wall and the core wire.

In a guide wire mounted sensor, the signals from the sensor, arranged at the distal end of the guide wire, are lead through the electrical leads to a male connector at the proximal end of the guide wire. In use, the male connector is connected to a corresponding female connector and the signals from the pressure sensor are transferred to an interface, which converts the signals and presents them in a desired form for an operator.

A conventional male connector for a medical device, basically comprises a core wire, a plurality of conductors, a plurality of conductive members, and insulating material therebetween. When the male connector is connected to the female connector, the conductive members transfer the signals from the conductors of the male connector to similar conductive members inside the female connector.

Several different designs of male connectors are known in the prior art, and examples of such male connectors are disclosed in U.S. Pat. No. 6,196,980 B1, U.S. Pat. No. 6,090,052 A, and U.S. Pat. No. 6,908,442 B2, which are assigned to the same assignee as in the present application.

For example, the male connector used today for guide wires is made by individually attaching each conductor (an electrical lead placed alongside a core wire) to a conductive member (a contact ring which is wrapped around the core wire). Each of the conductive members are connected, by bonding or soldering, respectively, to a conductor. The core wire is used to prevent kinks and to provide strength to the male connector. Especially when the male connector is inserted into the female connector, there is a substantial risk of over-bending the male connector or damaging the thin conductors inside the connector.

Soldering or bonding the conductive members to the conductors is a time-consuming process and may be a source of manufacturing mistakes, leading to loss of time and material in the manufacturing process. For example, there may be a risk that the conductive members and the conductors are not properly connected or that they disconnect due to over-bending of the male connector and this in its turn involves a risk for short circuit in the male connector.

Consequently, there remains a need for a male connector which is less expensive, easy and straightforward to manufacture and which reduces the risk of short circuit. In addition, there is a need for a male connector which is possible to test before assembling with the medical device.

There is also a need for a male connector which makes it possible to bond or solder all the electrical cables at one end of the finished module, whereby the male connector may be mounted in one piece to electrical cable(s) for e.g. a sensor guide wire.

SUMMARY OF THE INVENTION

Thus, the object of the present invention is to achieve an improved male connector that is easier to manufacture and assemble than presently used male connectors, and which mechanically is more stable and which not tend to kink when inserted into a female connector.

Further, the object of the present invention is to provide a method of manufacturing a male connector by injection-moulding.

The elongated male connector, for a medical device, in accordance with the present invention, has a longitudinal axis and comprises a plurality of conductive members, each having an outer contact surface and being separated from each other by insulating members. The conductive and insulating members are disposed along the male connector, such that the outer contact surfaces are arranged essentially at the same surface level, and that each of the conductive members has an elongated extension along the longitudinal axis of the male connector. Each conductive member is provided with an insulated microrod extending at least partially along the length of the male connector, and said conductive members are hollow and have an essentially cylindrical cross-section and form, together with said insulating members, a self-supporting male connector having no core wire. The male connector is adapted to any medical device adapted to be inserted into the body.

The invention will now be described in detail with reference to the drawings.

SHORT DESCRIPTION OF THE APPENDED DRAWINGS

Throughout the figures the same reference signs designate the same, or essentially the same features.

DETAILED DESCRIPTION OF PREFERRED EMBODIMENTS OF THE INVENTION

Throughout the application the word distal refers to the part located furthest away in respect of the operator, and the word proximal refers to the part located closest in respect of the operator.

Figure 1:
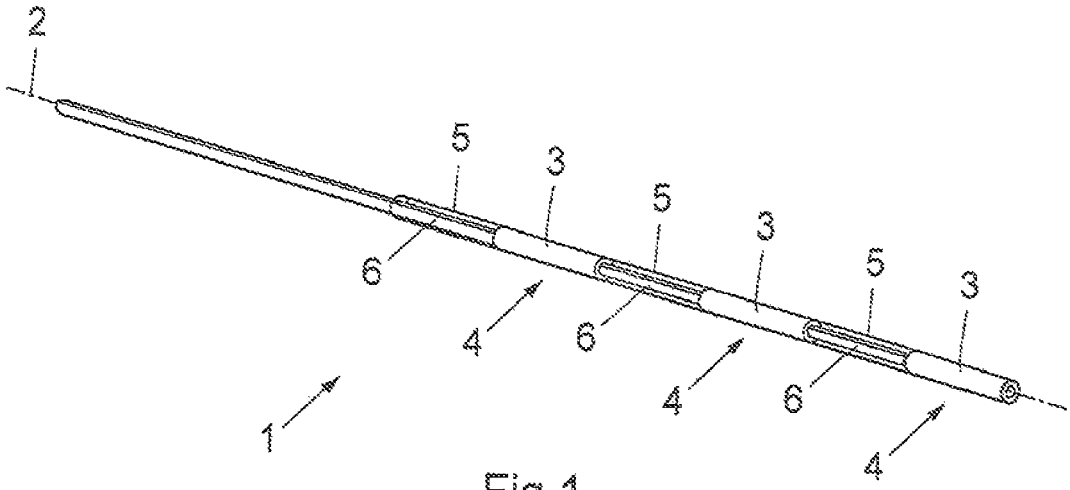
FIG. 1 shows the male connector according to the present invention.

In FIG. 1, an elongated male connector 1, for a medical device, according to the present invention, is disclosed. The male connector 1 has a longitudinal axis 2 and comprises a plurality of conductive members 3, each having an outer contact surface 4 and being separated from each other by insulating members 5, the conductive and insulating members 3, 5 being disposed along the male connector 1, such that the outer contact surfaces 4 are arranged essentially at the same surface level, and that each of the conductive members 3 has an elongated extension along the longitudinal axis 2 of the male connector 1.

Figure 2:
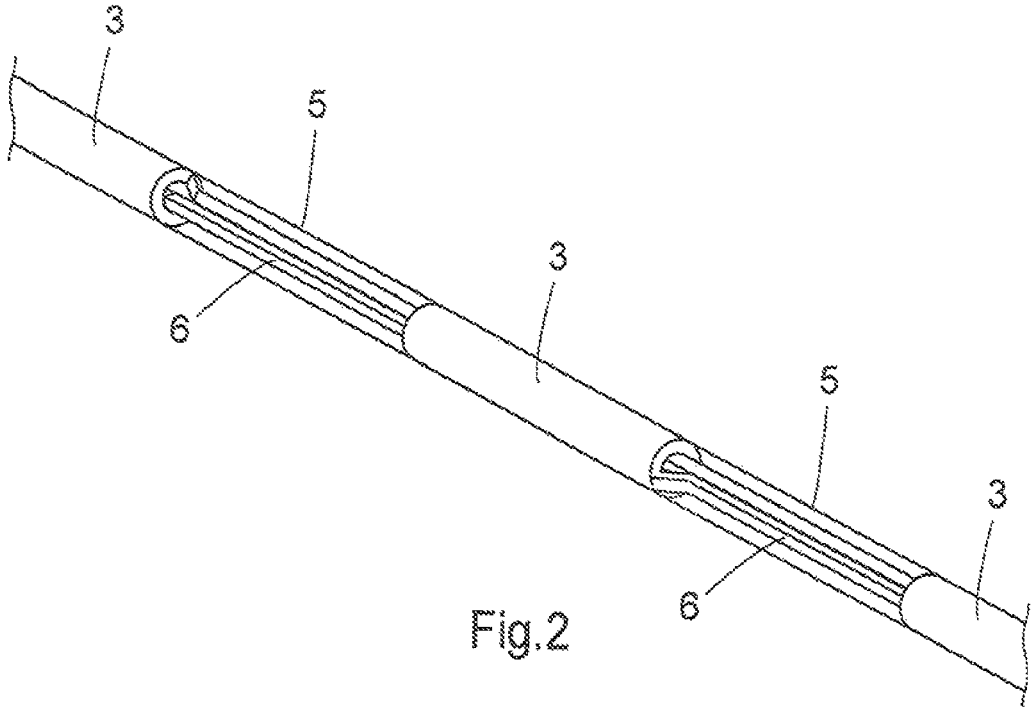
FIG. 2 shows a close-up view of the male connector according a first preferred embodiment of the present invention.

As illustrated in FIG. 2, each conductive member 3 is provided with an insulated microrod 6 extending at least partially along the length of the male connector 1. The conductive members 3 are hollow and have an essentially cylindrical cross-section and form, together with the insulating members 5, a self-supporting male connector 1 having no core wire. Thus, the male connector 1 consists merely of the conductive and insulating members 3, 5 and the insulated microrods 6.

The male connector is adapted to any medical device adapted to be inserted into the body. The medical device may be e.g a sensor guide wire for intravascular measurements of physiological variables in a living body. The sensor may be designed to measure temperature and/or flow e.g. within the vascular system. Miniature sensors may also be designed to measure other variables, such as magnetic flux, other electromagnetic variables, conductance, or inductance, e.g. generated from outside the body and used inter alia for positioning purposes.

As discussed above, and as shown in FIGS. 1-2, the outer contact surfaces 4 are arranged essentially at the same surface level. However, as one constructive variation, the surface level of the conductive members 3 may be arranged slightly elevated in respect to the surface level of the insulating members 5, i.e. the radius of the conductive members 3 is larger than the radius of the insulating members 5. As an example, the conductive members have a cross-sectional diameter of 0.2-0.4.

According to a preferred embodiment of the present invention, the microrods 6 are arranged to extend through more distally arranged conductive and insulating members 3, 5, as illustrated in FIGS. 1 and 2. The insulating members 5 are preferably made of LCP (Liquid Crystal Polymer), and the LCP is preferably injection-moulded onto the assembled male connector 1. However, other suitable materials, such as PEI (polyetherimide) or PEEK (polyetheretherketone), may also be used to insulate between the conductive members 3.

Figure 3:
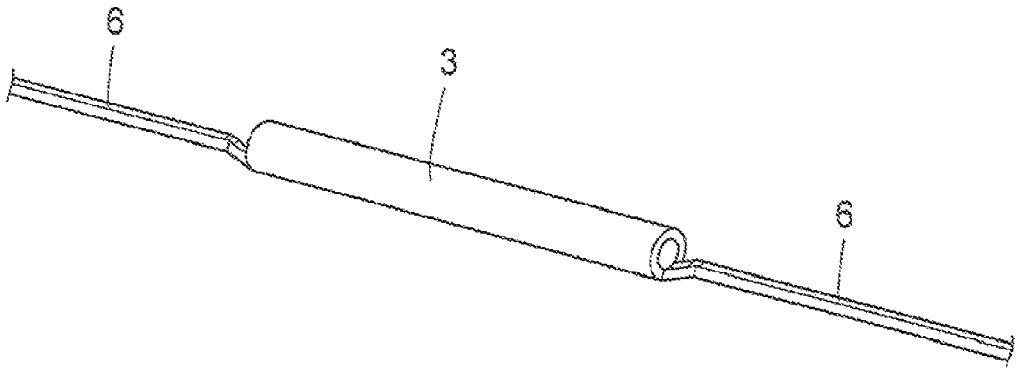
FIG. 3 shows a single conductive member provided with a microrod.

FIG. 3, shows a single conductive member 3, of a male connector 1 according to a first preferred embodiment of the present invention. In this preferred embodiment, the conductive members 3 have a circular cross-section, and the microrods 6 are adapted to be arranged to extend through more distally and more proximally arranged conductive and insulating members 3, 5. The microrods 6, connected to the conductive members 3, are preferably insulated with polyimide, or other suitable insulating material, such as oxide coating or acrylic insulation. The conductive members 3 provided with the microrods 6 are according to this preferred embodiment manufactured by cutting out separate units of conductive members 3 provided with microrods 6, preferably by laser, from an elongated tube (not shown).

In another embodiment, the conductive members 3 provided with microrods 6 may be produced by laser cutting a flat sheet of conductive material, e.g. sheet metal, and bent or rolled into a cylindrical shape.

Figure 4:
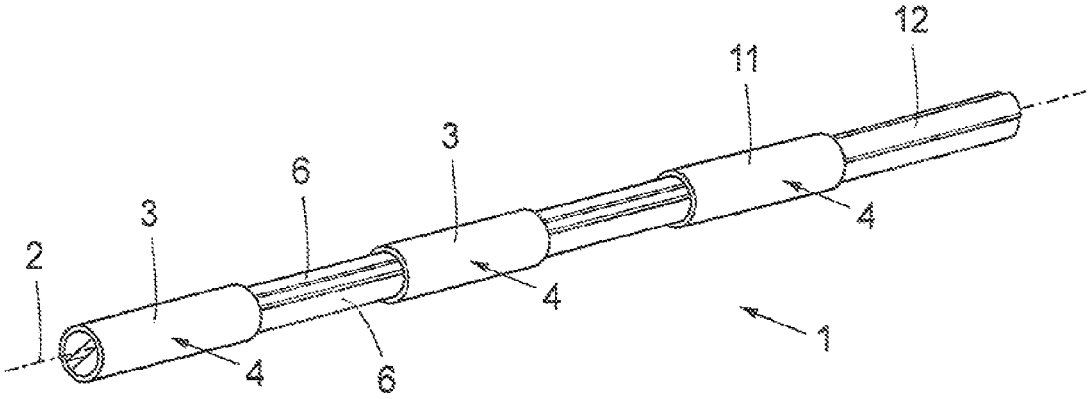
FIG. 4 shows the male connector, according to a second preferred embodiment of the present invention, in which figure, the insulating members have been omitted.

According to another preferred embodiment of the present invention, shown in FIG. 4, in which figure the insulating members have been omitted, the microrods 6 are arranged to extend through more distally, or both through more distally and more proximally, arranged conductive and insulating members 3, 5. Since the male connector 1 has no core wire, the microrods 6 instead support the conductive and insulating members 3, 5, to achieve a mechanically stable male connector 1 which does not kink. Thus, the microrods 6 support the conductive and insulating members 3, 5 and gives the male connector 1 the necessary stability and stiffness.

In other embodiments the microrods 6 instead are produced separately, and thereafter fastened to the conductive members 3. This may be achieved e.g. by means of spot-welding, or soldering, according to the embodiment shown in FIGS. 4 and 5. However, other suitable techniques, such as welding or gluing, may also be used to attach the microrods 6 to the conductive members 3. At least one of the microrods 6 are, according to this embodiment, fastened to the inner space 10 of the hollow conductive members 3.

Figure 5:
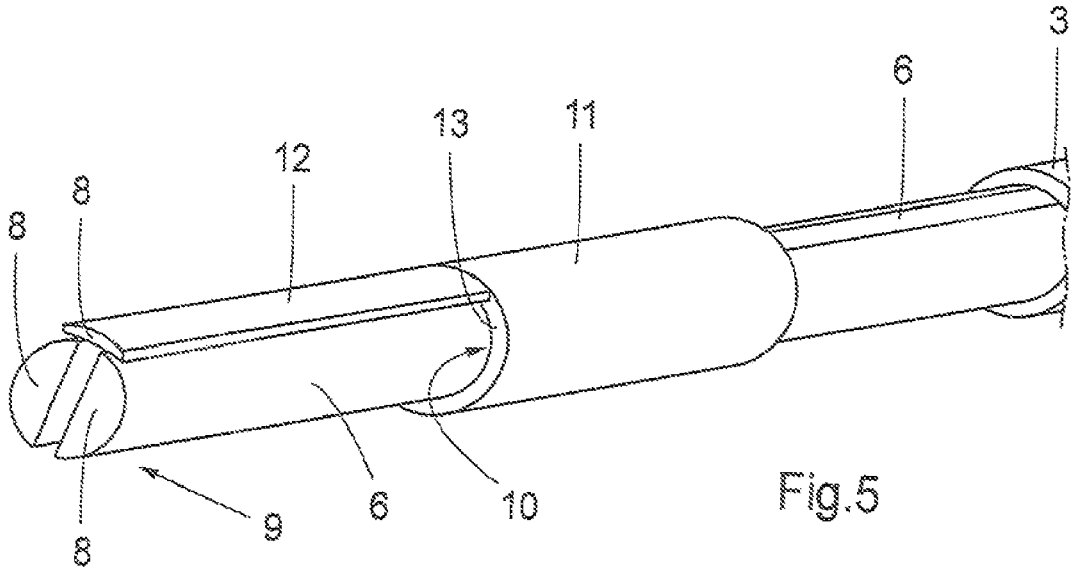
FIG. 5 shows the distal end of the male connector, according to a second embodiment of the present invention, in which figure, the insulating members have been omitted.

According to one embodiment of the present invention, the microrods 6 are provided with contact surfaces 8 at a distal end 9 of the male connector 1, as shown in detail in FIG. 5. When the male connector 1 is in use, the contact surfaces 8 are connected, preferably by welding, to electrical leads provided in the medical device, e.g. a sensor guide wire. Contact surfaces 8 at one end of the male connector 1 is advantageous since it makes it possible to test the male connector 1 before assembling with the medical device. Thereby, the risk for short circuit in the male connector module 1 is reduced. Also, having all the contact surfaces adjacent to each other at one end simplifies connecting several electrical leads to the male connector.

In the embodiment illustrated in FIG. 5, the microrods 6, have a semilunar cross-section. The dimensions of the semilunar microrods 6 are adapted to the diameter of the inner space 10 of the hollow conductive members 3, so that one or more microrods 6 may be arranged to extend through the conductive member 3 supported by the inner space 10 of the conductive members 3 to make the male connector 1 mechanically stable. As shown in FIGS. 4 and 5, the most distal arranged conductive member 11 may be provided with a distal microrod 12 having less dimensions than the other microrods 6 attached to the more proximal arranged conductive members 3. The distal microrod 12 is preferably attached to the distal edge 13 of the most distal arranged conductive member 11.

The present invention also relates to a method of producing the male connector 1, for a medical device. The method includes:

a) providing a plurality of hollow elongated conductive members 3 having a cylindrical cross-section and an outer contact surface 4, where each conductive member 3 is provided with an elongated insulated microrod 6;

b) arranging, spaced apart, a plurality of the conductive members 3 next to each other and centred along a longitudinal axis 2 with the microrods 6 extending through more distally arranged conductive members 3, and c) providing insulating members 5 between adjacent conductive members 3, thereby forming a self-supporting male connector 1 having no core wire.

According to the method for producing a male connector 1, step b) may further include the sub step of:

b1) arranging at least one of the microrods 6 to extend through at least one proximally arranged conductive member 3.

As a preferred method, and according to the preferred embodiment of the present invention shown in FIGS. 1-3, the hollow elongated conductive members 3 provided with the microrods 6, are manufactured at the same time, by cutting out separate units, preferably by laser, from an elongated tube, made of any commonly used conductive material, such as stainless steel, platinum or titanium. Each cut out conductive member 3 and microcable 6 are then insulated with a suitable insulating material, such as polyimide, oxide coating or acrylic insulation as is common in the art.

As also discussed above, and according to another embodiment, the conductive members 3 provided with microrods 6 may be produced by laser cutting a flat sheet of conductive material, e.g. sheet metal, and bent or rolled into a cylindrical shape.

However, in the embodiment illustrated in FIGS. 4-5, as discussed above, the microrods 6 are fastened to the conductive members 3 by means of spot-welding.

According to the method, the insulating members 5 may be provided by means of injection-moulding. In detail, the conductive members 3 provided with the microrods 6 are then arranged spaced apart, and next to each other, and adjacent conductive member 3 are threaded on to adjacent microrods 6, so that the microrods 6 extends through more distally and/or proximally arranged conductive members 3, as shown in FIGS. 4-5. Subsequently, the insulation is injection-moulded onto the microrods 6, between adjacent conductive members 3, in order to form the insulating members 5.

Furthermore, and according to the method, the microrods 6 are bonded or soldered at a distal end 9 of the male connector 1 to form a plurality of contact surfaces 8. Advantageously, all cable connector contact surfaces 8 to be connected to the desired medical device are then arranged at one end of the male connector 1.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. An elongated male connector for a medical device, the male connector having a longitudinal axis and comprising:

a plurality of conductive members, each having an outer contact surface, wherein each conductive member is separated from each other conductive member by at least one insulating member, wherein the conductive and insulating members are disposed along the male connector such that the outer contact surfaces are arranged essentially at a same surface level, wherein each conductive member is provided with a microrod extending at least partially along a length of the male connector, and wherein the conductive members are hollow and have an essentially cylindrical cross-section and form, together with the insulating members, a self-supporting male connector having no core wire, wherein the microrods support the conductive members and the insulating members to achieve a mechanically stable male connector.

2. An elongated male connector according to claim 1, wherein at least one microrod is arranged to extend through a more distally arranged conductive or insulating member.

3. An elongated male connector according to claim 1, wherein the conductive members have a circular cross-section.

4. An elongated male connector according to claim 1, wherein at least one conductive member is made of a flat sheet of conductive material which is bent or rolled into a cylindrical shape.

5. An elongated male connector according to claim 1, wherein at least one of the microrods is arranged to extend through a more proximally arranged conductive or insulating member.

6. An elongated male connector according to claim 1, wherein the insulating members are made of LCP (Liquid Crystal Polymer).

7. An elongated male connector according to claim 1, wherein the microrods are fastened to the conductive members by spot-welding.

8. An elongated male connector according to claim 1, wherein the microrods are fastened to the conductive members by soldering.

9. An elongated male connector according to claim 1, wherein at least one of the microrods has a semilunar cross-section.

10. An elongated male connector according to claim 1, wherein at least one of the microrods is insulated.

11. An elongated male connector according to claim 1, wherein the microrods are provided with contact surfaces at a distal end of the male connector, and the microrods are provided with an insulating coating such that electrical current can flow between a conductive member and a contact surface via a microrod.

12. An elongated male connector according to claim 1, wherein the male connector is configured to transmit signals from a medical device to an interface.

13. An elongated male connector according to claim 1, wherein the male connector is configured to be assembled with a medical device adapted to be inserted into a patient.

14. An elongated male connector according to claim 1, wherein the microrods are adapted to mate with an inner space of at least one of the conductive members.

* * * * *